US005749349A

United States Patent [19]

Detweiler et al.

[11] Patent Number: 5,749,349

[45] Date of Patent: May 12, 1998

[54] FUEL VAPOR CONTROL SYSTEM

[75] Inventors: Charles A. Detweiler, Durand; Daniel L. Deland, Davison; Gerrit V. Beneker, Algonac, all of Mich.

[73] Assignee: Eaton Corporation, Cleveland, Ohio

[21] Appl. No.: 738,939

[22] Filed: Oct. 24, 1996

[51] Int. Cl.[6] ..... F02M 37/04

[52] U.S. Cl. ..... 123/520; 123/198 D; 123/518

[58] Field of Search ..... 123/520, 519, 123/518, 516, 521, 198 D, 458

[56] References Cited

U.S. PATENT DOCUMENTS

| | | | |
|---|---|---|---|
| 4,951,637 | 8/1990 | Cook | 123/520 |
| 5,083,546 | 1/1992 | Detweiler | 123/520 |
| 5,115,785 | 5/1992 | Cook | 123/520 |
| 5,191,870 | 3/1993 | Cook | 123/520 |
| 5,199,404 | 4/1993 | Cook | 123/520 |
| 5,277,167 | 1/1994 | DeLand et al. | 123/518 |
| 5,429,099 | 7/1995 | Deland | 123/520 |
| 5,499,614 | 3/1996 | Busato | 123/520 |
| 5,603,349 | 2/1997 | Harris | 123/519 |

*Primary Examiner*—Carl S. Miller
*Attorney, Agent, or Firm*—Roger A. Johnston

[57] ABSTRACT

An electrically controlled vacuum operated valve controls flow of fuel vapors from a collector canister to the engine intake manifold. A pressure regulator controls fuel vapor flow from the canister to the inlet of the electric valve and is normally closed. During engine operation, if the control valve maintains a threshold level of vacuum at the regulator outlet, the regulator will permit fuel vapor flow from the canister to the control valve, otherwise the regulator is closed.

10 Claims, 2 Drawing Sheets

FUEL VAPOR CONTROL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to emission control systems employed with internal combustion engines and particularly emission control systems used in passenger car and light truck engines. The invention more particularly relates to the control of vapors given off by the fuel tank for engines operating on light hydrocarbon fuels such as gasoline.

In automotive applications where fuel tank vapors are collected in a canister containing adsorbent material such as granular carbon or charcoal material, an electrically controlled valve has been employed to control flow of the vapors from the canister through a conduit to the engine inlet manifold for charging such vapors into the engine inlet instead of permitting the vapors to escape to the atmosphere.

Heretofore, an electrically controlled valve operating with a vacuum supplied from the engine intake manifold has been employed to control the pressure differential across a diaphragm for modulating a control valve to control vapor flow from the canister to the engine intake manifold. An example of such a valve is that described in U.S. Pat. No. 5,277,167 issued Jan. 11, 1994 to DeLand, et al.

Also, with such a system, it has been found that with the engine not running, the pressure of the fuel vapors, particularly in hot weather, can build to a condition where the vapor pressure forces the control valve to the open position and permits the vapors to flow to the engine manifold and thus escape to the atmosphere through the engine inlet.

Efforts to remedy the problem of positive pressure in the vapor canister have involved increasing the spring bias on the diaphragm valve of the aforesaid prior art device to resist the positive canister pressure in the valve inlet from acting against the diaphragm to cause valve opening. However, with such increased diaphragm bias, once the engine is turned over to generate a vacuum or subatmospheric pressure signal from the intake manifold to the valve inlet sufficient to act on the diaphragm and overcome the bias less vapor pressure in the canister is needed to cause the valve to open; and, subsequently fuel vapor will flow to the engine inlet, even if the valve coil is not energized, and the engine will receive an overly rich mixture in the manifold causing rough operation. This may occur under deceleration when manifold vacuum is strong or when the engine is cranked and the engine may not start, or, if idling, may quit at idle.

Therefore, it has been desired to provide a way or means of electrically controlling the flow of fuel vapor from a receiving canister to the inlet of an internal combustion engine during engine operation and to prevent escape of the fuel vapor through the engine inlet under certain engine operating conditions and when the engine is not in operation.

BRIEF SUMMARY OF THE INVENTION

The present invention provides a pressure regulator for regulating the pressure of the fuel vapor from a storage/ receiving canister to an electrically controlled vacuum operated flow control valve for controlling flow of the fuel vapor to the engine inlet during engine operation. The pressure regulator of the present invention has a diaphragm actuated valve biased normally closed in the absence of a vacuum signal in the outlet to prevent flow from the fuel vapor canister when the engine is not in operation from entering the flow control valve. The present invention thus provides for retaining the fuel vapor in the canister to prevent release to the atmosphere during periods when the engine is unable to ingest the vapor without adverse effects.

DETAILED DESCRIPTION OF THE INVENTION

Figure 1:
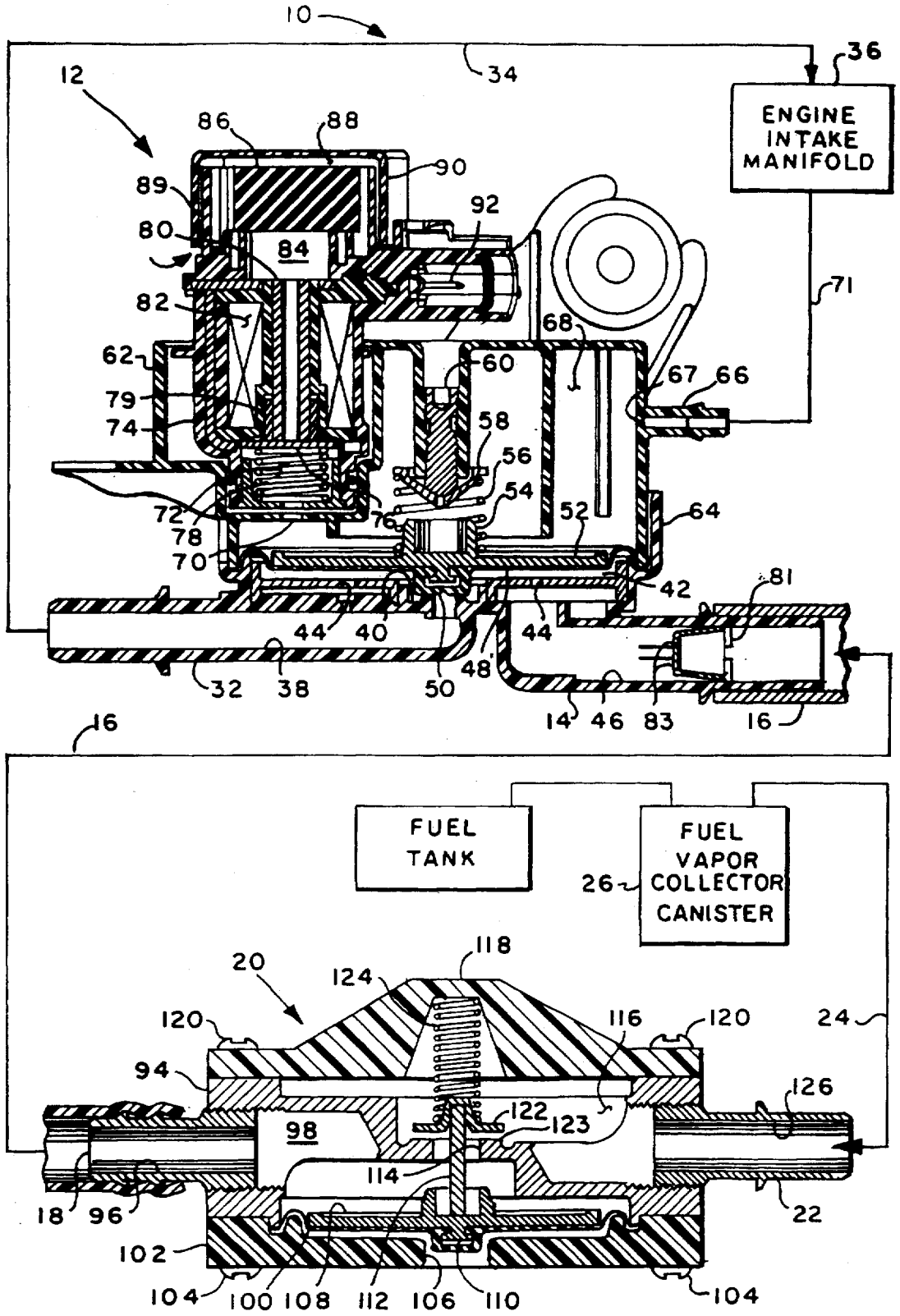
FIG. 1 is a pictorial schematic of the control system of the present invention showing the vapor control valve and pressure regulator in cross-section; and, FIG. 2 is a cross-section of an alternate embodiment of the pressure regulator of FIG. 1.

Referring to FIG. 1, one embodiment of the fuel vapor control system is indicated generally at 10 and includes an electrically operated vapor management valve indicated generally at 12 having a fuel vapor inlet fitting 14 connected by conduit 16, typically a flexible hose, to the outlet fitting 18 of a vacuum regulator indicated generally at 20 which has the inlet fitting 22 thereof connected via conduit 24 to a fuel vapor canister 26. Canister 26 receives fuel vapors through conduit 28 from a fuel tank 30.

Valve 12 has a fuel vapor outlet fitting 32 which is connected via conduit 34 to the engine inlet manifold 36 which, when the engine is in operation, maintains a vacuum in the interior passage 38 of the fitting 32. Passage 38 communicates with a valve seat 40 which communicates with a valving chamber 42 which communicates via a plurality of bleed holes 44 with the interior 46 of inlet fitting 14.

Valving chamber 42 is closed by a pressure responsive diaphragm 48 which has attached thereto a valve poppet 50 which contacts valve seat 40 for controlling fuel vapor flow and vacuum pressure between inlet passage 46 and outlet passage 38. In the presently preferred practice, diaphragm 48 has a central stiffening or backing plate 52 provided on the surface thereof exterior to chamber 42; and, plate 52 has a central spring guide or pilot 54 formed thereon. Pilot 54 has one end of a compression spring 56 received thereover with the upper end of the spring registered on a seating washer 58 which is adjustably positioned by a set screw 60 threaded into the casing or housing shell 62.

Shell 62 is attached to a lower housing shell 64 which preferably has formed integrally therewith fittings 32 and 46. Shells 62 and 64 effect a seal about the periphery of the diaphragm 48 for defining valving chamber 42.

Upper housing shell 62 has a vacuum fitting 66 provided thereon, the interior of which communicates through orifice 67 with chamber 68 formed above diaphragm 48; and, housing shell 62 has formed therein a vacuum inlet port 70 which admits atmospheric air into chamber 68. It will be understood that vacuum fitting 66 is connected via a conduit 71 to the engine intake manifold 36 for providing a vacuum signal to chamber 68.

Atmospheric vent port 70 of the upper housing shell 62 communicates with a valving chamber 72 formed in a well portion of housing 62 by a valve body 74. Chamber 72 has disposed therein a moveable valve plate 76 which is biased by a spring 78 into contact with a non-magnetic valve seat member 79 which is flanged to maintain an air gap between the end of magnetic pole piece in the form of a tube 80; and, valve plate 76, is received over the lower end of the pole piece 80. An end of a tube 80 is disposed centrally in a solenoid coil 82. The upper end of tube 80 communicates with a chamber 84 which is covered by a porous, preferably foam rubber, filter 86 which communicates with a chamber 88 formed above the filter by a cap 90. Chamber 88 communicates with an annular space 89 formed about the cap which communicates with the atmosphere as denoted by the black arrow in FIG. 1.

Coil 82 is connected to connector terminals such as terminal 92 for external electrical connection thereto. In the present practice of the invention coil 82 receives a modulated electrical signal for controlling the valve, as will hereinafter be described, to maintain a desired vacuum in chamber 68 which thus serves as a vacuum accumulator. Upon receipt of the electrical signal, coil 60 is energized and causes magnetic attraction of the valve plate 76 to the valve seat 79. Thus, the force of attraction of the magnetic field of the pole piece 80 and the force exerted by spring 78 are additive to oppose the forces of the pressure drop across the armature exerted over the area of the valve seat and to restrict vent flow. Upon de-energization of the coil and vacuum build up in chamber 68 creating a pressure differential across diaphragm 48 sufficient to overcome the force of spring 78, the valve plate 76 is caused to move and to open the vent allowing atmospheric air to enter chamber 68 and reduce the vacuum in the chamber and thus the pressure differential across diaphragm 48, which in turn permits spring 56 to cause poppet 50 to close valve 50 against seat 40. It will be understood, that by increasing the current in coil 82, the greater the vacuum produced in chamber 48 and the more diaphragm 52 is lifted. Lifting diaphragm 48 increases the opening of poppet 50 from valve seat 40, thereby permitting greater vacuum in chamber 42 and greater flow through bleed holes 44 and restrictor holes 43 and thus greater flow from inlet 46 to outlet 32.

With the engine off, the vacuum in chamber 68 is depleted and reaches and remains at atmospheric pressure, which along with force of spring 56 acts on the upper surface of diaphragm 48 and valve 50 remains closed until vapor canister pressure reaches 35 mm Hg.

It will be understood that bleed holes 44 and an upstream flow restrictor in the form of a pressed-in cup 81 having orifices 83 restrict vapor flow such that a slight vacuum or subatmospheric pressure is maintained in the valving chamber 42 below the diaphragm 48.

Referring to the lower view of FIG. 1, the vacuum pressure regulator 20 has a body 94 with vacuum outlet fitting 18 attached thereto with the interior 96 of fitting 18 communicating with a chamber 98 formed above a flexible diaphragm 100 which is sealed about its periphery onto the body 94 by a cap 102 attached to and secured to the body by any suitable expedient, as for example, fasteners 104. The cap 102 has an atmospheric vent port 106 formed therein for venting the underside of the diaphragm 100.

Diaphragm 100 has a stiffening or backing plate 108 disposed on the upper surface thereof and secured thereto such as by a projection or knob 110 formed on the undersurface thereof which is snapped into a pocket formed in the center of the diaphragm.

Plate 108 engages the lower end of a rod 112 which has its upper end extending through a valving passage 114 formed in the body which passage communicates with an inlet chamber 116 closed by a second cap 118 secured to the body by fasteners 120. The upper end of rod 112 engages a valve plate 122 which is biased downwardly by the lower end of a spring 124 having the upper end thereof registered against the undersurface of cap 118. It will be understood that inlet chamber 116 communicates with the interior 126 of inlet fitting 22.

Although valve 122 is shown in the open position in FIG. 1, it will be understood that spring 124 applies sufficient preload on valve 122 to maintain the valve closed against the seat 123 when the engine is not running.

In the present practice of the invention, the spring 78 of valve 12 is set to provide a preload on valve plate 76 sufficient to generate 30 mm Hg vacuum in accumulator chamber 68. The magnetic force of attraction generated by the current in coil 82 produces an additional 5 mm Hg in chamber 68 to provide a total of 35 mm Hg vacuum in chamber 68, when the valve 50 starts to open. Further increasing the current in the coil 82 increases the vacuum in chamber 68 and increases the flow through the valve 50.

In operation, with the engine running, the vacuum signal from passage 46 of the vapor management valve 12 is applied through conduit 16 and passage 96 of outlet 18 of regulator 20 to chamber 98 and creates a pressure differential across diaphragm 100 (the lower surface is vented to atmosphere) causing the diaphragm to push rod 112 upwardly raising normally closed valve plate 122 from the valve seat 123 thereby permitting vapor flow from inlet passage 126 to outlet passage 96 via valving passage 114. Further increases in the vacuum depression in the passage 46 of the vapor management valve 12 tend to cause the diaphragm 100 to lift valve plate 122 further from seat 123 and thus increase the flow of fuel vapor from the canister 26 to the inlet of valve 20. Similarly, a depletion of the vacuum in passage 46 of the vapor management valve 12, either by changes in the electrical control signal to coil 82 and movement of valve 50; or decreases in the engine intake manifold as for example, during acceleration or by turning off the engine, cause the diaphragm 100 of regulator 20 to move downwardly and permit valve plate 122 to close on seat 123 shutting off the flow of fuel vapor.

However, during periods of engine shut-off or loss of vacuum in chamber 68 such as by increased engine load, in the event the fuel vapor pressure in canister 26 builds sufficiently, spring 124 maintains valve plate 122 closed against seat 123. Otherwise, if valve 122 were not closed, vapor would pass through passage 46 into chamber 42 of the vapor management valve 12 raising diaphragm 48 and causing poppet 50 to unseat and permit vapor flow to the engine intake manifold and escape to the atmosphere through the engine manifold inlet or, if the engine is running produce an overly rich mixture.

With the engine running, and no current flowing in coil 82, the spring 78 maintains 30 mm Hg vacuum in chamber 68 and thus only 5 mm Hg positive pressure in the fuel vapor canister if applied through conduit 16 and into chamber 42 would raise diaphragm 48 and open valve 50. However, in the present invention, regulator 20 maintains a vacuum in chamber 42 and prevents slugging the engine with extra fuel vapor which cause rough idling, stalling and excessive hydrocarbon exhaust emissions. The regulator 20 has its valve 122 normally closed. During engine operations, as diaphragm 48 lifts poppet 50 in valve 12, a vacuum signal is created in chamber 42 and is transmitted via bleed holes 44, restrictor holes 83 and conduit 16 to chamber 98 of regulator 20 and causes diaphragm 100 to lift valve 122 to permit fuel vapor flow. In the present practice of the invention, a vacuum of 15 mm Hg is required in chamber 42 and chamber 92 in order for valve 122 to open.

Figure 2:
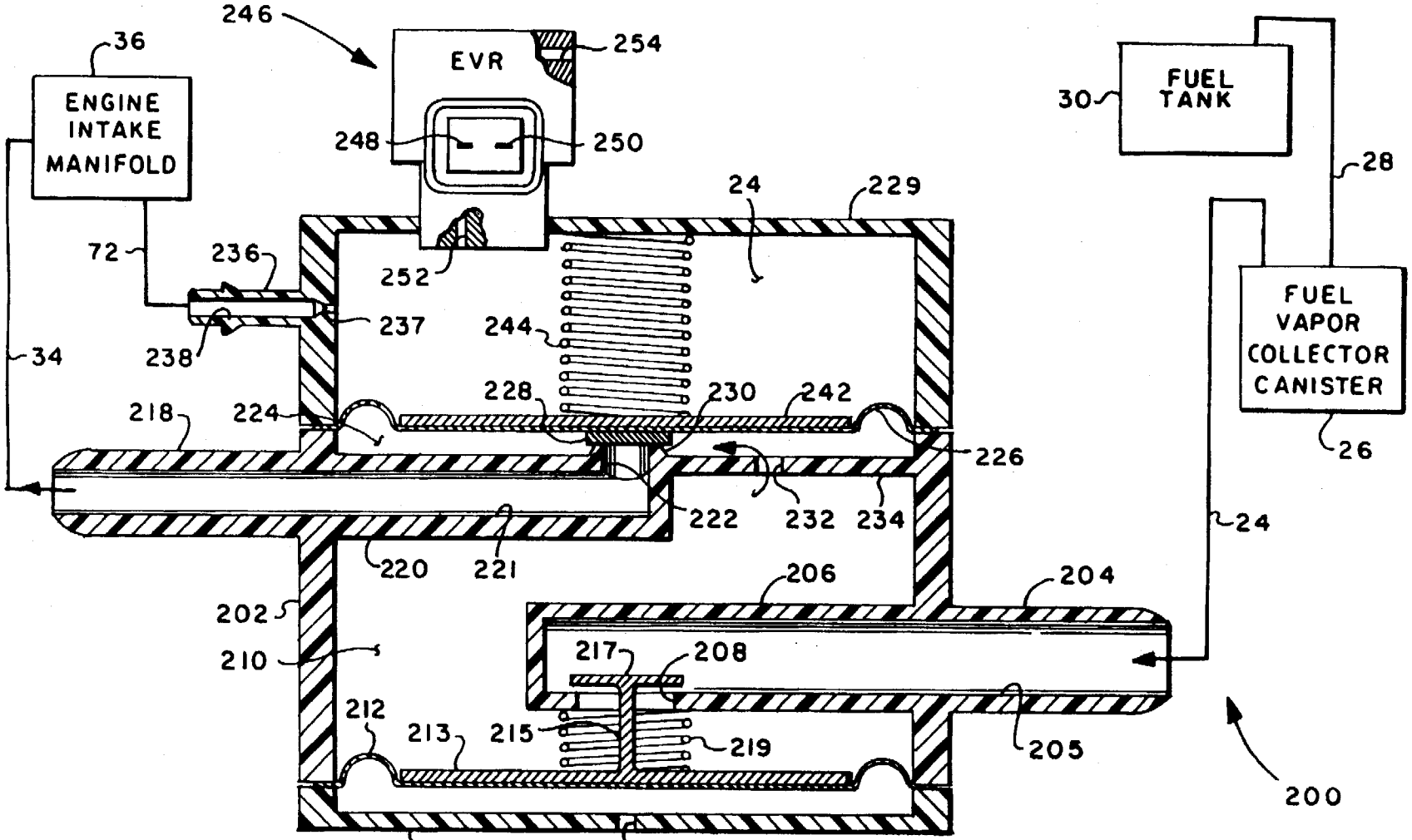

Referring to FIG. 2, an alternate embodiment of the invention is indicated generally at 200 and has a combined vapor management valve and regulator body 202 which has a vapor inlet fitting 204 extending outwardly therefrom and connected to conduit 24 from the fuel vapor canister 26. Fitting 204 has a portion 206 extending inwardly of the body 202 and has a valving passage 208 formed on the interior closed end thereof which communicates with a chamber 210 formed within the body 202. Chamber 210 is closed by a pressure responsive diaphragm 212 sealed on the body 202 about the periphery thereof by a cap 214 which vents one side of the diaphragm 212 to atmosphere through port 216. Cap 214 is secured and sealed to body 202 by any suitable expedient as for example weldment.

Body 202 has an outlet fitting 218 extending therefrom which is connected to the vacuum line 34 from the engine intake manifold 36 and has a closed portion 220 thereof which extends inwardly of the body 202 and has formed therein a valving passage 222 which communicates with an upper chamber 240 which is closed by a diaphragm 226 sealed about its periphery on body 202 by cap 229. Cap 229 is secured and sealed to body 202 by any suitable expedient, such as weldment.

Diaphragm 226 has a portion thereof defining a moveable valve member 228 which is operable to close upon a valve seat 230 formed about the upper end of valving passage 222. The lower chamber 210 communicates with the upper chamber 240 via a port 232 formed in a dividing wall portion 234 of the body 202.

Cap 229 has a vacuum fitting 236 formed thereon which has an internal passage 238 which communicates with chamber 240 via orifice 237. Diaphragm 226 has a backing plate 242 provided on the upper surface thereof against which is registered one end of a spring 244 which has its upper end registered against cap 229 and biases the diaphragm in a downward direction to cause valve 228 to contact seat 230.

Diaphragm 212 has a central backing plate 213 contacting the upper surface thereof and which has a rod 215 preferably integrally formed therewith extending upwardly through valving passage 208 and connected preferably integrally to a moveable valving member or plate 217. A spring 219 has one end registered against the undersurface of valving passage 208 and the lower end registered against backing plate 213 to bias diaphragm 212 in a downward direction and causes valve 217 to seat against the upper end of passage 208.

An electrically operated vent valve indicated generally at 246 has electrical connector terminals 248, 250 thereon for electrical connection thereto for energization of a solenoid to provide venting of the chamber 240 to the atmosphere through a passage 252 communicating with chamber 240. The valve 246 is operable on energization to prevent communication between an external vent port 254 and atmospheric vent port 252. It will be understood that the construction of the valve 244 may, if desired, be similar to that the of the electrical valve shown and described in the embodiment of FIG. 1.

Regulator valve 217 is normally closed. In operation, the running of the engine produces a vacuum signal in passage 238 which reduces the pressure in chamber 240 raising diaphragm to 242 to cause valve 228 to open to create a vacuum in chamber 224 and chamber 210 through bleed hole 232. The vacuum in chamber 210 creates a differential pressure across diaphragm 212 causing the valve plate 217 to be raised and permit fuel vapor from canister 26 to enter passage 205 and flow through passage 232 and valve passages 222 and 221 to the engine manifold via conduit 34.

With the engine shut off or operating in a mode to provide very little vacuum provided in passage 221, spring 219 closes valve 217 and prevents fuel vapor flowing to the engine intake manifold.

The present invention thus provides an electrically controlled vacuum operated fuel vapor control valve for controlling flow of fuel vapor from a canister to an engine intake manifold and includes a pressure regulator valve which is actuated by a vacuum signal from the vapor control valve. The regulator is operable to close in the event a loss of vacuum signal occurs from the vapor control valve. The automatic closing feature of the regulator prevents positive pressure from the full vapor canister from being able to open the vapor control valve when engine vacuum is low or when the engine is off.

Although the invention has hereinabove been described with respect to the illustrated embodiments, it will be understood that the invention is capable of modification and variation and is limited only by the scope of the following claims.

We claim:

1. A system for controlling the injection of fuel tank vapors into the inlet manifold of an internal combustion engine comprising:

(a) an electrically controlled vacuum operated flow control valve having an inlet and outlet and vacuum signal port, with the outlet and vacuum signal port thereof connected to said inlet manifold;

(b) a regulator valve having the outlet thereof connected to the inlet of said flow control valve and the inlet of said regulator valve adapted for connection to a fuel tank vapor collection canister, said regulator valve having:

(i) a body defining said inlet and a valving chamber communicating with said inlet, said chamber defining a valving port communicating with a passage which communicates with said regulator valve outlet, (ii) an obturator member disposed in said valving chamber for movement with respect to said valving port and means biasing said obturator to close said valving port;

(iii) a pressure responsive member forming a portion of said outlet passage, (iv) means connecting said pressure responsive member to said obturator member, and (v) means resiliently biasing said obturator member in a direction tending to close said valving port; and, wherein, with vacuum in said regulator outlet less than a predetermined level said valving port is closed by said obturator member; and, with engine running and said control valve operative to provide a predetermined level of vacuum in said regulator outlet, wherein said level of vacuum applied to said pressure responsive member causes said obturator to be opened with respect to said valving port and wherein, with the engine off, said valving port is closed and fuel tank vapor pressure above atmospheric is operative to act on said obturator and assists in closing said valving port.

2. The system defined in claim 1, wherein said bias means is adjustable for providing a predetermined preload on said obturator member.

3. The system defined in claim 1, wherein said means connecting said pressure responsive member to said obturator member includes a rod passing through said valving port; and, said pressure responsive member comprises a flexible diaphragm connected to said rod at one end thereof.

4. The system defined in claim 1, wherein said flow control valve includes a vacuum chamber connected to said manifold and a solenoid operated bleed valve for controlling pressure in said vacuum chamber, and a diaphragm moveable in response to changes in pressure in said chamber wherein said diaphragm is operative to effect movement of a valve member for controlling flow between an inlet and said outlet connected to said manifold.

5. A method of controlling flow of fuel tank vapor into the inlet manifold of an internal combustion engine comprising:

(a) providing an electrically operated flow valve and connecting the outlet thereof to a manifold inlet and electrically energizing the flow valve and controlling flow of fuel tank vapor from the valve inlet to the outlet;

(b) connecting a pressure regulator outlet to the inlet of said valve and connecting the regulator inlet to a source of fuel tank vapor and regulating the pressure of fuel vapor to said valve inlet; and, (c) closing said regulator and blocking flow to the outlet when insufficient vacuum is experienced at the outlet connected to the said flow valve and permitting flow when a predetermined vacuum is experienced at the regulator outlet; and, (d) maintaining said regulator closed when the pressure of said tank vapor rises above atmospheric with the engine off.

6. The method defined in claim 5, wherein said step of blocking flow to the regulator outlet includes attaching a valve member to a pressure responsive member and moving the valve member in response to negative outlet pressure acting on the pressure responsive member.

7. The method defined in claim 5, wherein said step of blocking flow to said regulator outlet includes providing a moveable valve member and valve seat communicating with said inlet and biasing said valve member against said seat.

8. The method defined in claim 5, wherein said step of electrically energizing said flow valve includes duty-cycle modulating.

9. The method defined in claim 5, wherein said step of electrically controlling flow includes moving a bleed valve member and bleeding atmospheric air to a pressure chamber connected to the engine manifold vacuum and moving a pressure responsive member responsive to the pressure in said chamber.

10. The method defined in claim 5, wherein the step of maintaining said regulator closed includes applying fuel tank vapor pressure to assist in maintaining said regulator closed.

* * * * *